US009708876B2

(12) United States Patent
Painter et al.

(10) Patent No.: US 9,708,876 B2
(45) Date of Patent: Jul. 18, 2017

(54) RAM ASSEMBLIES FOR BLOWOUT PREVENTERS

(71) Applicant: Cameron International Corporation, Houston, TX (US)

(72) Inventors: Jay P. Painter, Friendswood, TX (US); Michael C. Krejci, Houston, TX (US); Alan Davis, Houston, TX (US); Kevin Leow, Singapore (SG); Sufian Mohamed Arip, Singapore (SG)

(73) Assignee: Cameron International Corporation, Houston, TX (US)

( * ) Notice: Subject to any disclaimer, the term of this patent is extended or adjusted under 35 U.S.C. 154(b) by 115 days.

(21) Appl. No.: 14/183,241

(22) Filed: Feb. 18, 2014

(65) Prior Publication Data

US 2015/0184481 A1 Jul. 2, 2015

Related U.S. Application Data

(60) Provisional application No. 61/921,911, filed on Dec. 30, 2013.

(51) Int. Cl.
*E21B 33/06* (2006.01)

(52) U.S. Cl.
CPC ..... *E21B 33/062* (2013.01)

(58) Field of Classification Search
CPC ..... E21B 33/062
USPC ..... 251/1.1, 1.2, 1.3, 214
See application file for complete search history.

(56) References Cited

U.S. PATENT DOCUMENTS

| | | | | |
|---|---|---|---|---|
| 3,023,994 | A * | 3/1962 | Gibson | E21B 33/062 251/1.3 |
| 3,904,212 | A | 9/1975 | Pugh et al. | |
| 3,939,910 | A | 2/1976 | Bruce | |
| 4,332,367 | A * | 6/1982 | Nelson | 251/1.3 |
| 4,506,858 | A * | 3/1985 | Gentry | 277/325 |
| 4,930,745 | A * | 6/1990 | Granger et al. | 277/325 |
| 4,938,290 | A * | 7/1990 | Leggett et al. | 166/387 |
| 5,009,289 | A * | 4/1991 | Nance | E21B 33/062 188/67 |
| 5,294,088 | A * | 3/1994 | McWhorter et al. | 251/1.3 |
| 5,538,080 | A | 7/1996 | Bassinger | |
| 5,833,208 | A * | 11/1998 | Lee, Jr. | E21B 33/062 251/1.1 |
| 5,863,022 | A | 1/1999 | Van Winkle | |
| 6,089,526 | A * | 7/2000 | Olson | 251/1.3 |
| 6,260,817 | B1 * | 7/2001 | Lam et al. | 251/1.3 |
| 6,296,225 | B1 | 10/2001 | Watts | |
| 6,974,135 | B2 * | 12/2005 | Melancon | E21B 33/062 251/1.2 |
| 7,137,610 | B2 * | 11/2006 | Lam | 251/1.3 |
| 7,464,765 | B2 * | 12/2008 | Isaacks | E21B 19/24 166/378 |

(Continued)

*Primary Examiner* — Jessica Cahill
*Assistant Examiner* — Daphne M Barry
(74) *Attorney, Agent, or Firm* — Eubanks PLLC

(57) ABSTRACT

A ram assembly is provided. In one embodiment, the ram assembly includes a base ram having a tapered profile and a seal coupled to the base ram in a manner that allows the seal to slide relative to the base ram during operation of the ram assembly. In some instances in which the ram assembly is installed in a blowout preventer, the tapered profile of the base ram can facilitate compression of the seal in multiple directions. Additional systems, devices, and methods are also disclosed.

14 Claims, 17 Drawing Sheets

(56) References Cited

U.S. PATENT DOCUMENTS

2007/0284115 A1* 12/2007 McCreedy ..... E21B 33/08
166/379
2011/0226475 A1 9/2011 Springett et al.

* cited by examiner

RAM ASSEMBLIES FOR BLOWOUT PREVENTERS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Further, such systems generally include wellhead assemblies mounted on wells through which resources are accessed or extracted. These wellhead assemblies can include a wide variety of components, such as various spools, casings, valves, pumps, fluid conduits, and the like, that facilitate drilling or extraction operations. More particularly, wellhead assemblies often include a blowout preventer, such as a ram-type blowout preventer that uses one or more pairs of opposing rams to restrict flow of fluid through the blowout preventer. The rams typically include main bodies (or ram blocks) that receive sealing elements (or ram packers) that press together when a pair of opposing rams close against one another.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to ram assemblies that can be used to seal a fluid conduit, such as a bore within a blowout preventer. In some embodiments, a ram assembly has a tapered base ram that carries other components of the assembly, including a seal. The taper of the base ram interacts with other components of the assembly to translate a portion of a horizontal load on the base ram (i.e., a load pushing the base ram toward a closed position) to a vertical load applied to the seal. In a blowout preventer context, this facilitates compression of the seal against an opposite ram and against a surface of the blowout preventer body. The taper of the ram assemblies can be provided in various forms, such as with a curved tapered surface or a planar tapered surface. Also, the seal can be provided in contact with the base ram or can be separated from the base ram by one or more other components.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
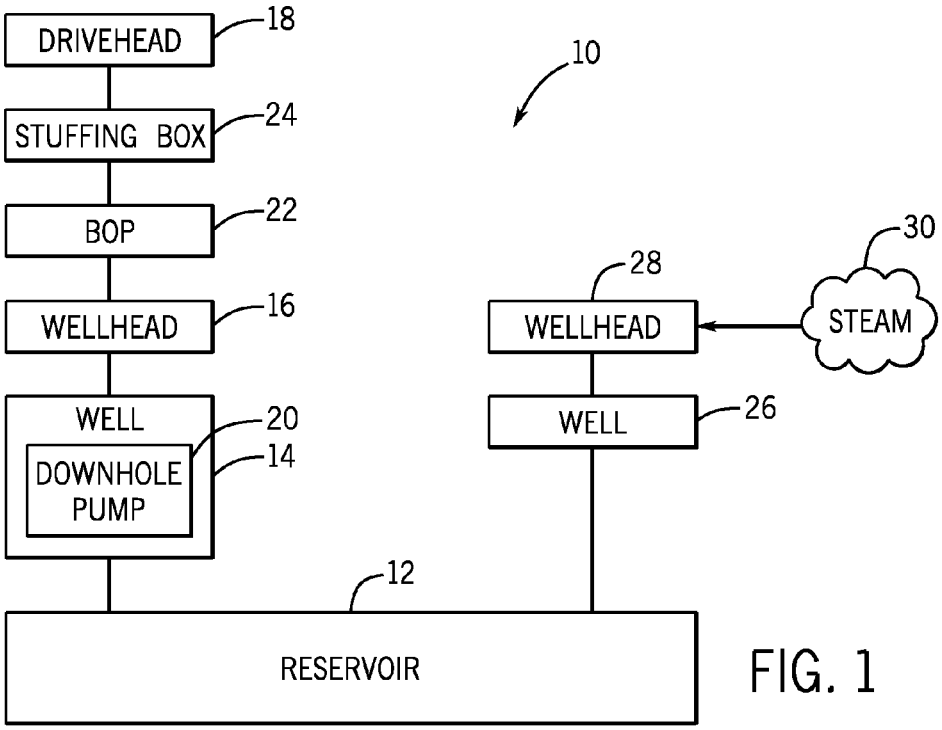
FIG. 1 generally depicts a production system having a blowout preventer installed on a wellhead in accordance with one embodiment of the present disclosure.

Turning now to the present figures, a system 10 including a blowout preventer is illustrated in FIG. 1 in accordance with one embodiment. Notably, the system 10 is a production system that facilitates extraction of a resource, such as oil, from a reservoir 12 through a well 14 and a wellhead 16. In one embodiment, the wellhead 16 includes a casing head and a tubing head. But the components of the wellhead 16 can differ between applications, and such equipment could include various casing heads, tubing heads, pumping tees, and pressure gauges, to name only a few possibilities.

Production systems sometimes rely on artificial lift to help raise fluid from the reservoir 12 to the surface. As here depicted, such artificial lift is provided by a drivehead 18 that controls operation of a downhole pump 20. By way of example, the drivehead 18 can cooperate with a prime mover (e.g., an engine or motor) to impart movement to a component of the downhole pump 20 via a rod string. It is noted, however, that other arrangements for providing artificial lift could be used as well.

The system 10 also includes a blowout preventer 22 and a stuffing box 24 coupled to the wellhead 16. The blowout preventer 22 includes one or more elements, such as rams, operable to seal a bore through the blowout preventer and inhibit flow of wellbore fluid through the bore. The blowout preventer 22 can be coupled directly to the wellhead 16 or indirectly via one or more other components, such as an adapter spool. As noted above, the drivehead 18 can be connected to the downhole pump 20 with a rod string. In at least some embodiments, such a rod string extends through a bore of the blowout preventer 22, which includes rams that can be closed about the rod string inside the bore. The stuffing box 24 includes one or more seals that engage the rod string and allow it to move while inhibiting leaking of fluid along the rod string.

As depicted in FIG. 1, the system 10 is a steam-assisted gravity drainage (SAGD) system having a second well 26 and wellhead 28. Although not shown in the present figure, a blowout preventer can be provided on the wellhead 28. The second well 26 can be drilled alongside the first well 14 within the reservoir 12, and steam 30 can be pumped down the well 26 to cause pores of rock in the reservoir 12 to widen. This increases flow of fluids (e.g., oil) through the pores and into the well 14. The fluids can then be pumped to the surface via the downhole pump 20. While the steam 30 may promote fluid flow within the reservoir 12 and enhance production from the well 14, the steam 30 can also increase the temperature of fluids in the well 14. In at least some embodiments, the blowout preventer 22 includes seals operable to seal off wellbore pressure (e.g., 3,000 psi) even at elevated temperatures (e.g., 650° F.).

Figure 2:
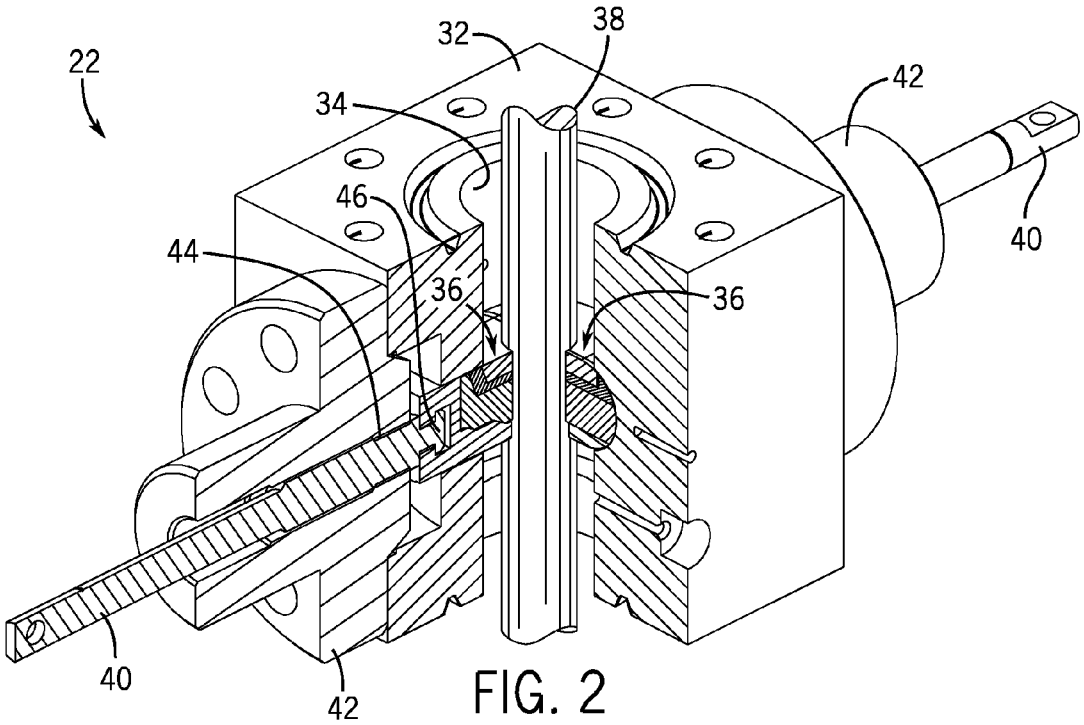
FIGS. 2 and 3 depict an example of the blowout preventer of FIG. 1 as having ram assemblies in accordance with one embodiment.
Figure 3:
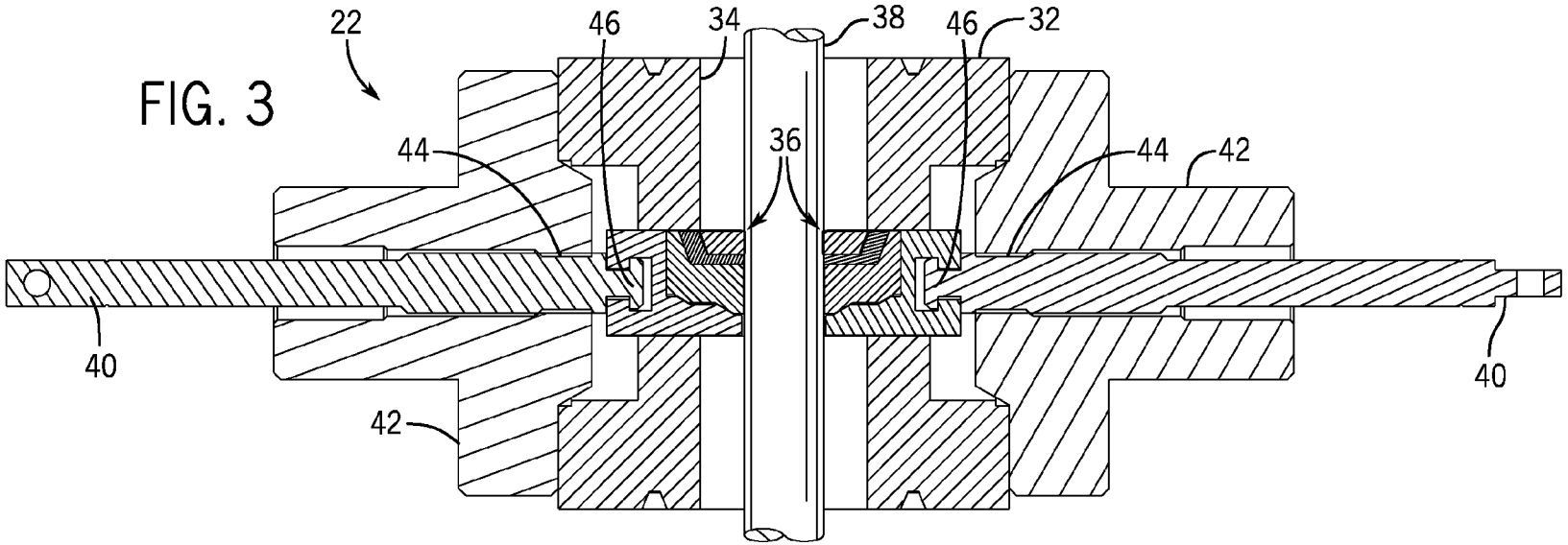

One example of a blowout preventer 22 is depicted in FIGS. 2 and 3. In this embodiment, the blowout preventer 22 includes a hollow body 32 having a bore 34 and ram assemblies 36 that are installed in cavities of the body 32. The ram assemblies 36 are depicted here as pipe rams, but the ram assemblies could be provided in different forms (e.g., blind rams) in other embodiments. As described in additional detail below, the depicted ram assemblies 36 are movable within the blowout preventer 22 to selectively seal against one another and against a cylindrical member, such as rod 38, in the bore 34. The rod 38 can be a polished rod provided as part of a rod string connecting the drivehead 18 to the downhole pump 20. The ram assemblies 36 are connected to rods 40 extending through bonnets 42 attached at opposing ends of the body 32. The rods 40 and the bonnets 42 share threaded interfaces 44 that allow rotation of the rods 40 to cause lateral movement of the ram assemblies 36 between open and closed positions within the blowout preventer 22. The rods 40 include distal buttons 46 that are received by the ram assemblies 36 and facilitate retraction of the ram assemblies 36 away from the rod 38 when moving from the closed position (depicted in FIG. 2) to the open position.

Figure 4:
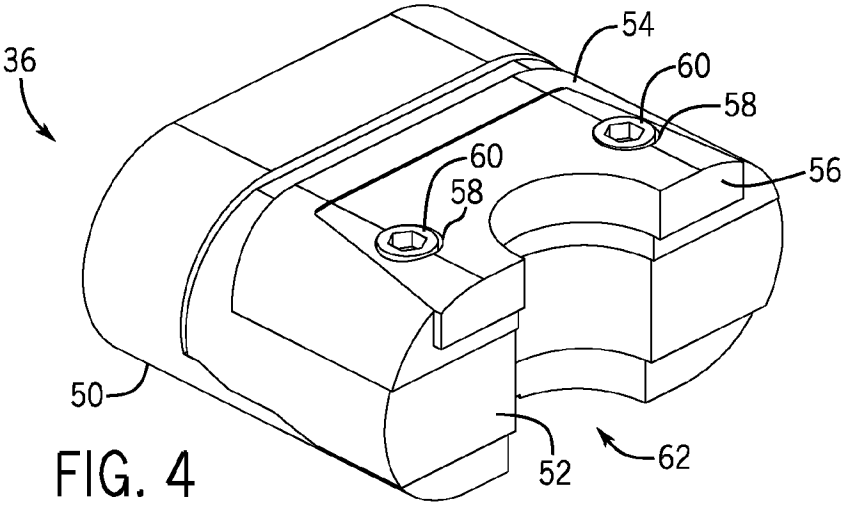
FIG. 4 is a perspective view of one of the ram assemblies of FIGS. 2 and 3 in accordance with one embodiment.
Figure 5:
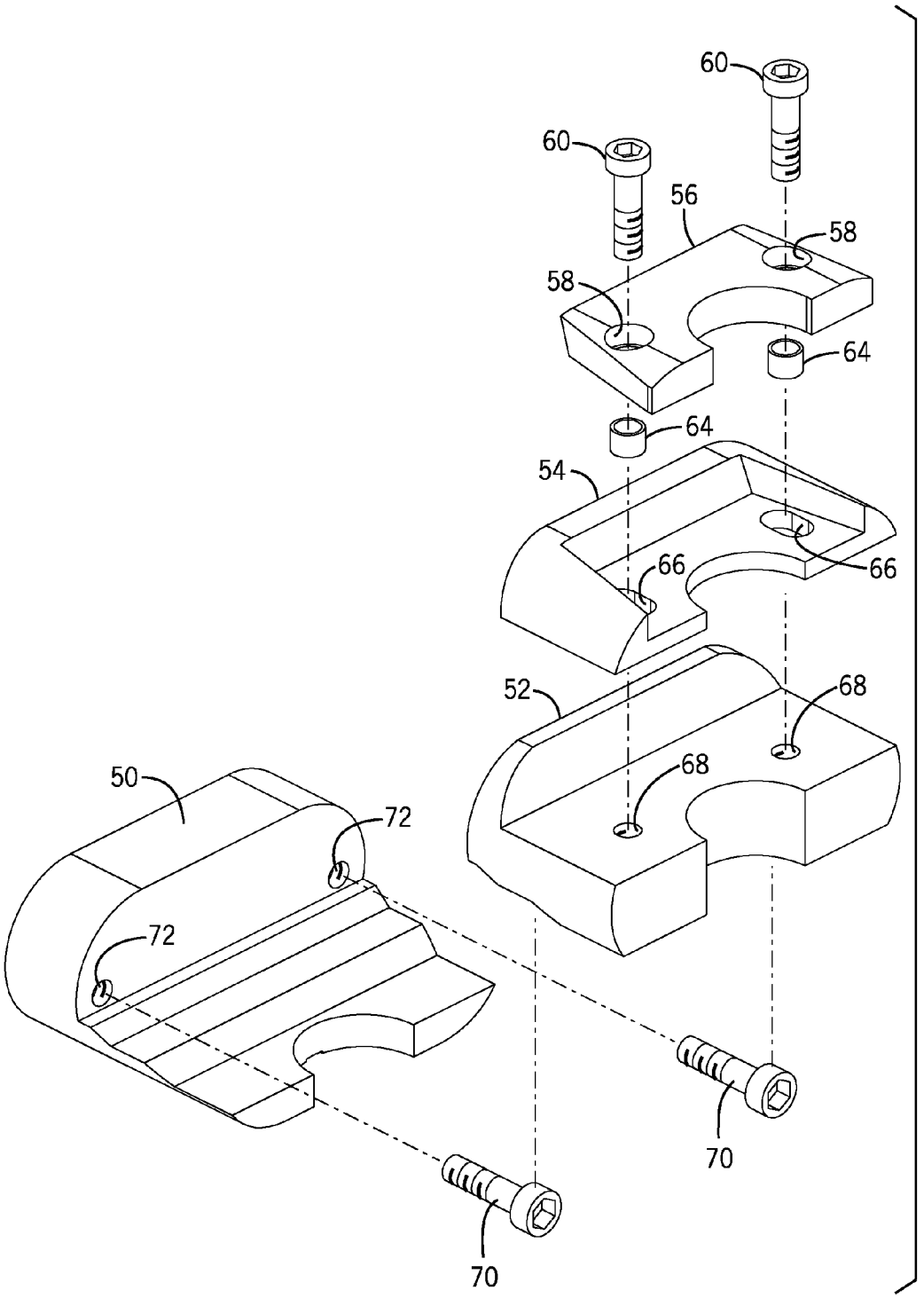
FIG. 5 is an exploded view showing various components of the ram assembly of FIG. 4, including a base ram, a rider ram, a seal, and a top plate in accordance with one embodiment.

By way of example, a ram assembly 36 is illustrated in greater detail in FIGS. 4 and 5 in accordance with one embodiment. The depicted ram assembly 36 includes a base ram 50, a rider ram 52, a seal 54, and a top plate 56 coupled to one another. In the presently depicted embodiment, the ram assembly 36 is shaped to fit within a u-shaped cavity in the body 32. Particularly, the base ram 50, the rider ram 52, the seal 54, and the top plate 56 each have curved sides that are collectively shaped and cooperate with one another so as to enable installation of the ram assembly 36 in a u-shaped cavity of the body 32. But the ram assembly 36 could be provided in other shapes as well.

The ram assembly 36 has a recess 62 for receiving the rod 38 when the ram assembly 36 is moved into a closed position in the blowout preventer 22. As shown in FIG. 5, various fasteners are used to retain the base ram 50, the rider ram 52, the seal 54, and the top plate 56 to one another. Particularly, fasteners 60 (here provided as cap screws) can be inserted through holes 58 in the top plate 56, through holes 66 in the seal 54, and then screwed into threaded holes 68 of the rider ram 52. This generally prevents the seal 54 and the top plate 56 from disconnecting from the rider ram 52 during operation of the ram assembly 36. In some embodiments, such as that depicted in FIG. 5, the holes 66 are provided as elongated slots that allow the seal 54 to slide along the rider ram 52 while remaining fastened with fasteners 60. Spacer rings 64 can be provided about the fasteners 60 within the holes 66 to reduce the volume within the holes 66 into which wellbore fluid could flow. In one embodiment, the spacer rings 64 are taller than the holes 66 so that, when sitting flush against the rider ram 52, the spacer rings 64 extend out of the upper end of the holes 66 and are received in counter-bored portions of the holes 58 in the top plate 56. Additional fasteners 70 (here again provided as cap screws) can be screwed into threaded holes 72 of the base ram 50. Heads of the fasteners 70 can be received by mating slots of the rider ram 52 (see FIG. 9) to retain the rider ram 52, the seal 54, and the top plate 56 with the base ram 50.

Figure 6:
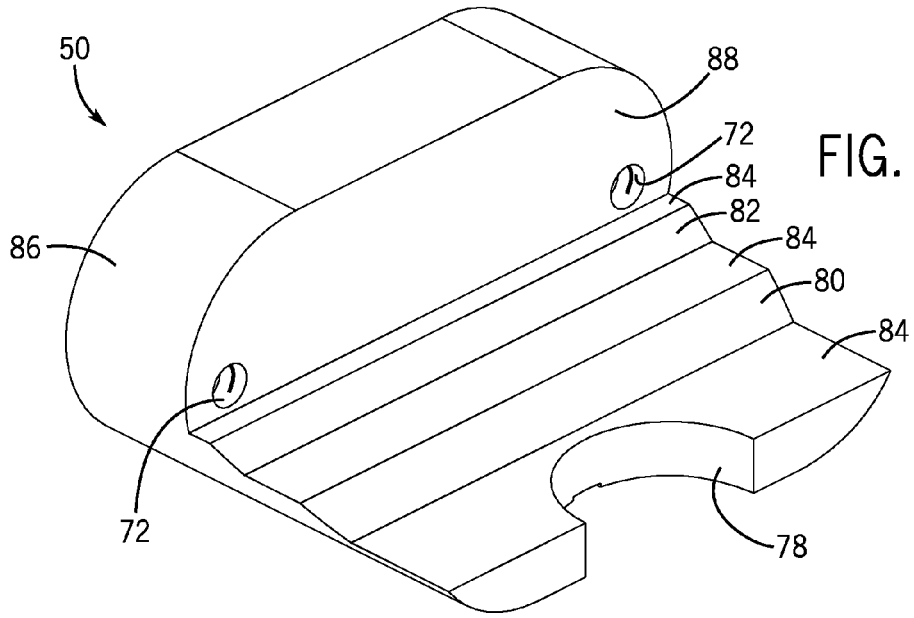
FIGS. 6 and 7 depict the base ram of FIG. 5 and show the base ram as having a tapered surface for engaging the rider ram.
Figure 7:
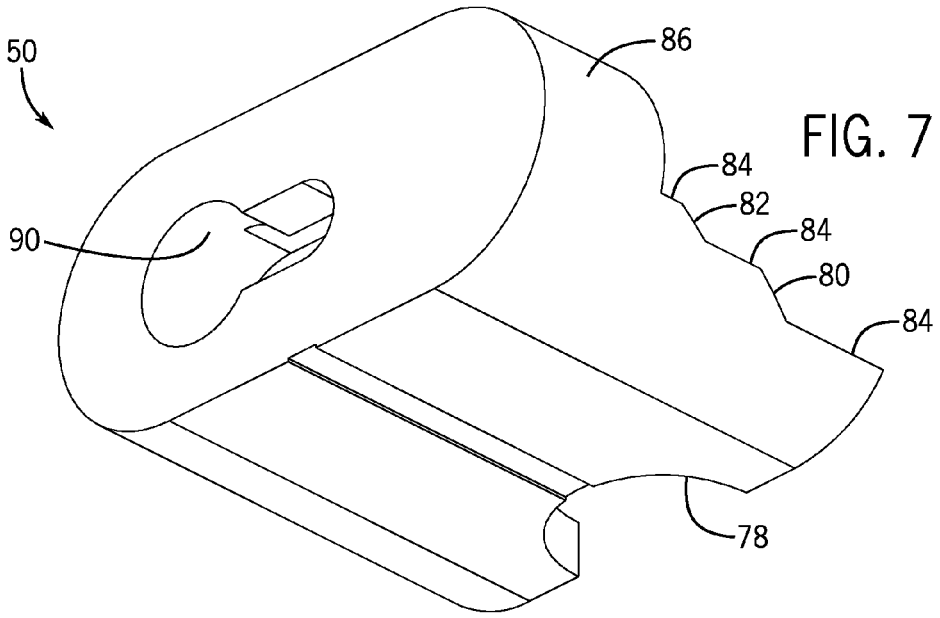

Additional details of the components of the ram assembly 36 are illustrated in FIGS. 6-15 by way of example. As shown in FIGS. 6 and 7, the base ram 50 includes a recess 78 that allows the base ram 50 to close around a cylindrical member, such as the rod 38 (FIG. 2). The recess 78 can be sized to allow the base ram 50 to be fully closed in the blowout preventer without contacting the rod 38. For instance, the recess 78 can be semi-circular with a radius greater than that of the portion of the rod 38 received within the recess 78.

In at least some embodiments, ram assemblies include base rams with tapered profiles. As described in additional detail below, the tapered profiles of the base rams can translate horizontal load to vertical load to facilitate sealing of the ram assemblies against the blowout preventers above the ram assemblies. The base ram 50 is illustrated in FIG. 6 with one example of such a tapered profile. More specifically, the depicted base ram 50 includes a wedge profile with inclined surfaces 80 and 82, along with surfaces 84 that are parallel to the bottom of the base ram 50. The surfaces 80, 82, and 84 are shown as planar surfaces in FIG. 6, although any of these surfaces could have a different configuration than that shown here. The inclined surfaces 80 and 82 are formed at thirty-degree angles with respect to their adjacent surfaces 84 in one embodiment, but the surfaces 80 and 82 can be inclined by different amounts in other embodiments. And while the base ram 50 is shown here as having a pair of inclined surfaces 80 and 82, other embodiments are also envisaged, such as a base ram with one inclined surface and a base ram with more than two inclined surfaces.

The base ram 50 includes a shoulder 86 with a front surface 88 having the holes 72 for receiving the fasteners 70 and retaining the rider ram 52. The base ram 50 also includes a keyhole slot 90 (FIG. 7) on its rear face for receiving the button 46 of a rod 44. The bottom surface of the base ram 50 can be milled flat to promote pressure equalization between the front end having recess 78 and the back end having slot 90 and reduce the likelihood of the ram assembly 36 jamming in the blowout preventer 22 due to pressure lock.

Figure 8:
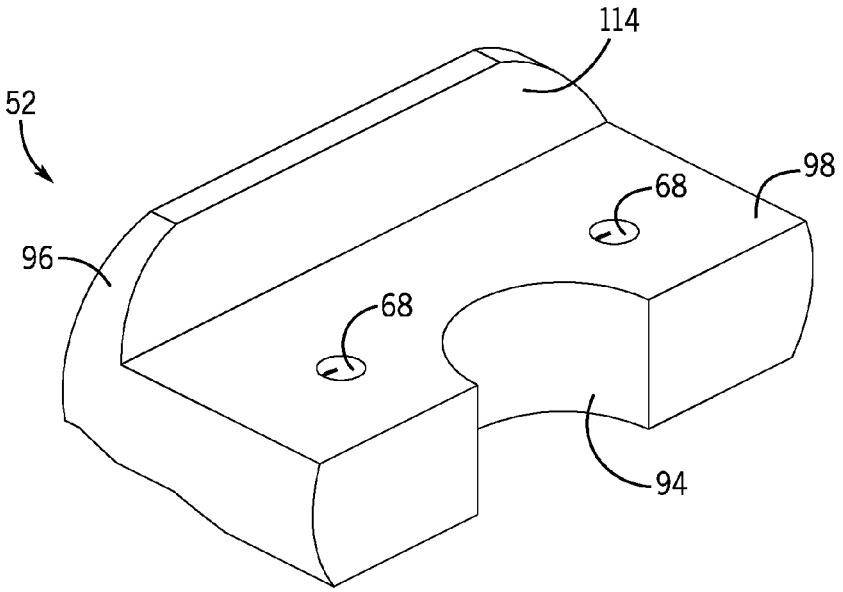
FIGS. 8 and 9 depict the rider ram of FIG. 5, which includes a mating surface for engaging the tapered surface of the base ram.
Figure 9:
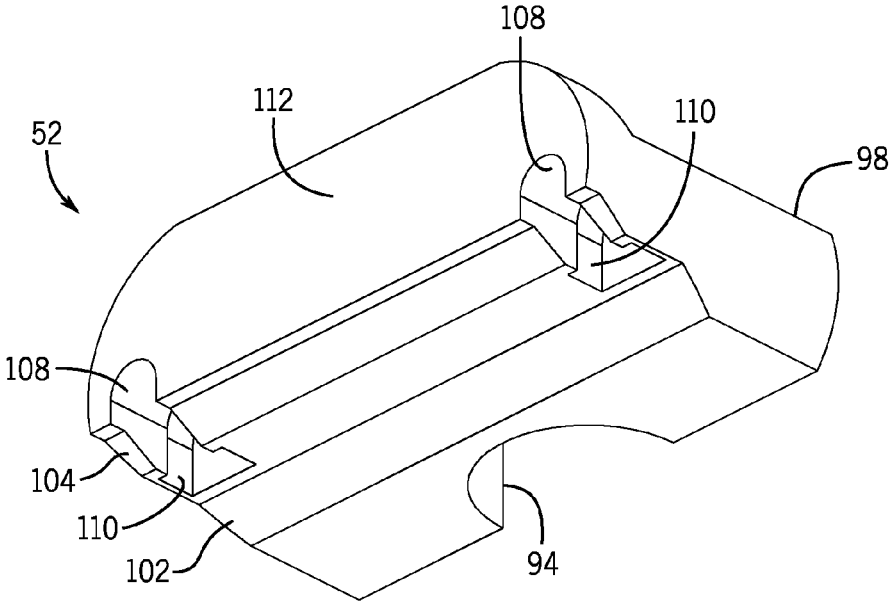

The rider ram 52 may be positioned on the tapered portion of the base ram 50. As shown in FIGS. 8 and 9, the rider ram 52 includes a recess 94 for receiving the rod 38. The recess 94, like recess 78 above, can be sized such that the rider ram 52 does not contact the rod 38 when the ram assembly 36 is closed. The rider ram 52 includes a shoulder 96 with a front face 114 that facilitates compression of the seal 54 (which can be carried on upper surface 98) when the ram assembly 36 is closed. The shoulder 96 can be sized to increase clearance between the shoulder 96 and the surface of the blowout preventer body 32 above the ram assembly 36 and facilitate additional compression of the seal 54 against the body 32.

The rider ram 52 includes a lower surface that generally complements the upper tapered surface of the base ram 50. As depicted in FIG. 9, the rider ram 52 includes inclined surfaces 102 and 104 that complement the inclined surfaces 80 and 82 of the base ram 50. These mating interfaces facilitate sliding of the rider ram 52 up the base ram 50 toward the shoulder 86 during closing of the ram assembly 36. Moreover, as discussed in greater detail below with respect to FIGS. 18-21, the interaction of the inclined surfaces 80, 82, 102, and 104 as the ram assembly 36 is closed cause the rider ram 52 to lift off the flat surfaces 84 of the base ram 50 and compress the seal 54 against a surface of the blowout preventer body 32 above the ram assembly 36.

The rider ram 52 also includes slots 108 that facilitate retention of the rider ram 52 to the base ram 50. As generally depicted in FIG. 5, the slots 108 receive fasteners 70, ends of which extend from a rear face 112 of the rider ram 52 and are threaded into the base ram 50 as described above. Heads of the fasteners 70 are positioned in enlarged portions 110 of the slots 108 to retain the rider ram 52 on the base ram 50 when the ram assembly 36 is moved from its closed position about the rod 38 to its open position.

Figure 10:
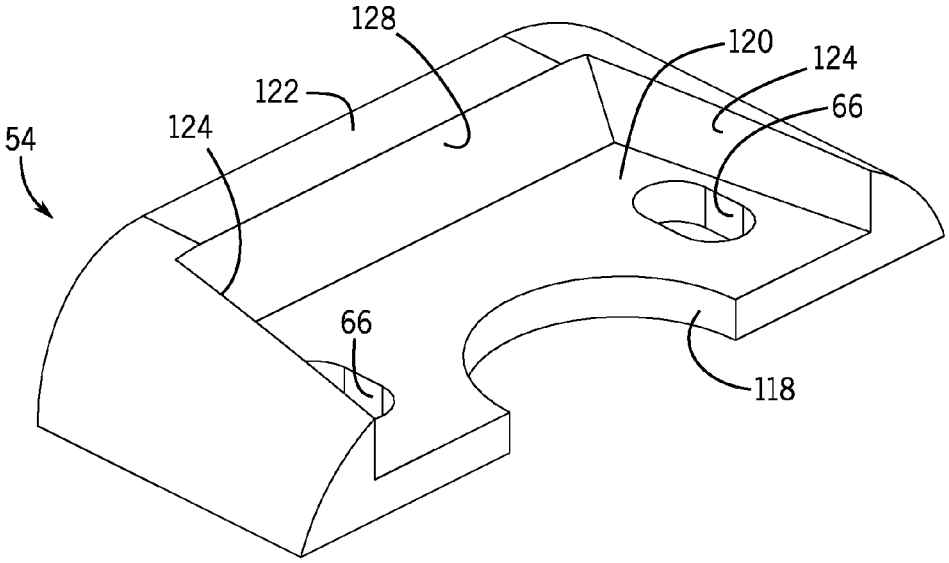
FIGS. 10-12 depict the seal of FIG. 5, which may be carried by the rider ram.
Figure 11:
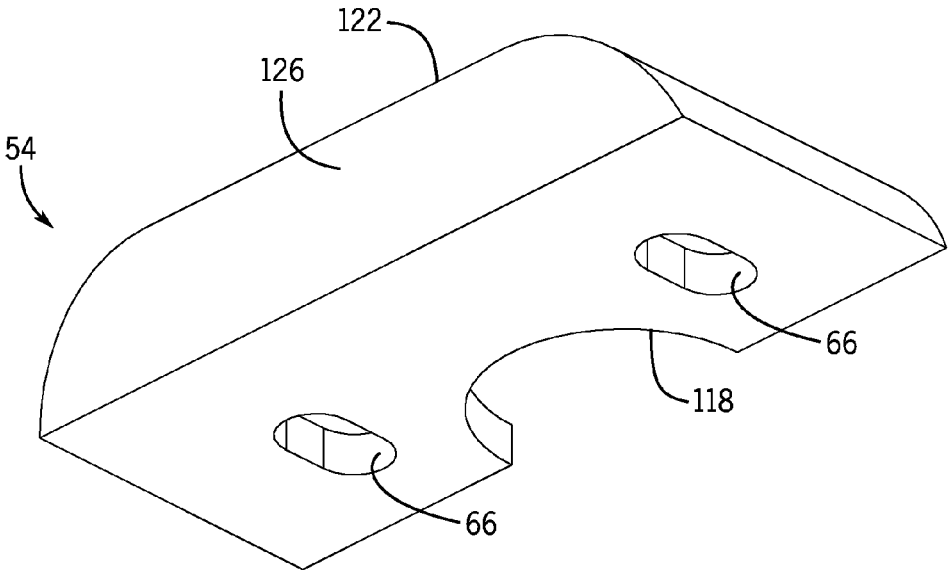
Figure 12:
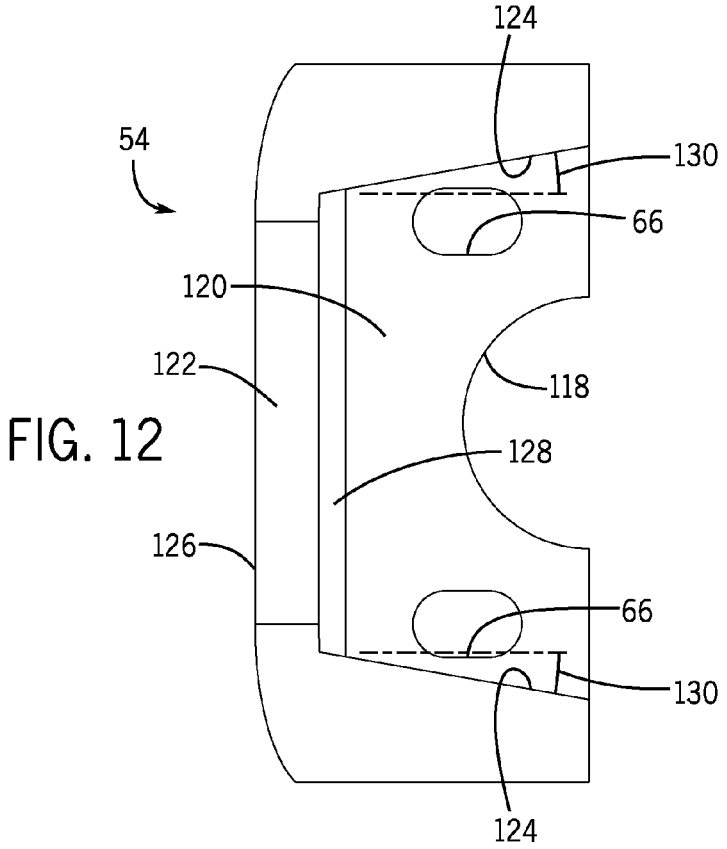

One example of the seal 54 is depicted in greater detail in FIGS. 10-12. The seal 54 includes a recess 118 for receiving the rod 38. This recess 118 is sized to engage and seal against the rod 38 when the ram assembly 36 is closed. The seal 54 also includes a recessed portion or cavity 120 generally bound by sides 124 and a shoulder, which is depicted in FIG. 10 as having an upper surface 122 and a front face 128. A rear face 126 of the seal 54 abuts the front face 114 of the rider ram 52 when the ram assembly 36 is closed. In at least some embodiments, the seal 54 is designed to seal against the rod 38, a seal 54 of an opposing ram assembly 36, the rider ram 52, and the cavity of the blowout preventer body 32 in which the ram assembly 36 is installed. As depicted in FIG. 12, the opposing sides 124 are formed at angles 130 to facilitate compression of the seal 54 when the BOP rams are closed. Further, the opposing sides 124 and the front face 128 can be tapered at draft angles to promote sealing. The rear face 126 can also be tapered for mating engagement with the rider ram 52.

As noted above with respect to FIG. 5, the seal 54 includes holes 66 for receiving fasteners 60 that secure the top plate 56 to the rider ram 52 and, in certain embodiments, spacer rings 64 can be provided within these holes 66. In one embodiment, the spacer rings 64 are hollow cylinders fitted into the holes 66 to reduce the material flow into the voids of the holes 66 and maintain the contact seal needed to achieve pressure sealing. When installed, the spacer rings 64 can sit flush with the lower surface of the seal 54 against the rider ram 52 and protrude out from the upper end of the holes 66 (i.e., beyond the surface of the recessed portion 120 about the holes 66). The protruding portions of the spacer rings 64 can be received within counter-bored portions of the holes 58 on the underside of the top plate 56 (see, e.g., FIG. 14).

The seal 54 can be formed of any suitable material. In at least some embodiments, the seal 54 is a graphite seal. The use of graphite may facilitate sealing of the ram assembly 36 in high-temperature and high-pressure operating conditions (e.g., 3000 psi at 650° F.). It also allows the seal 54 to be molded into various desired shapes and sizes while promoting sealing by permitting the seal 54 to deform to bridge any surface imperfections when compressed. But the seal 54 can be formed with any suitable materials, such as with one or more of various polymers, carbon, or ceramics.

Figure 13:
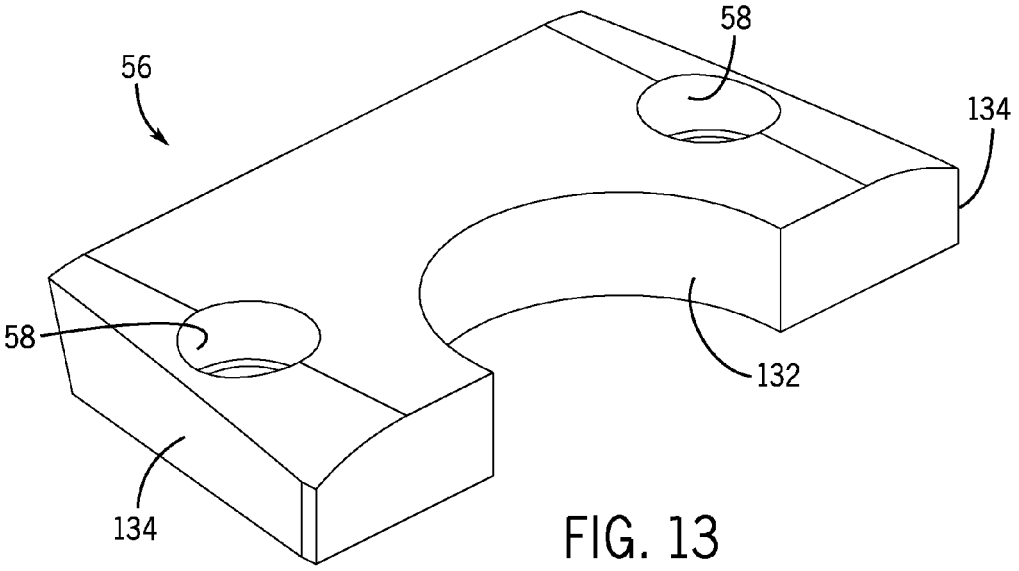
FIGS. 13-15 depict the top plate of FIG. 5, which can be carried within a recess in the seal.
Figure 14:
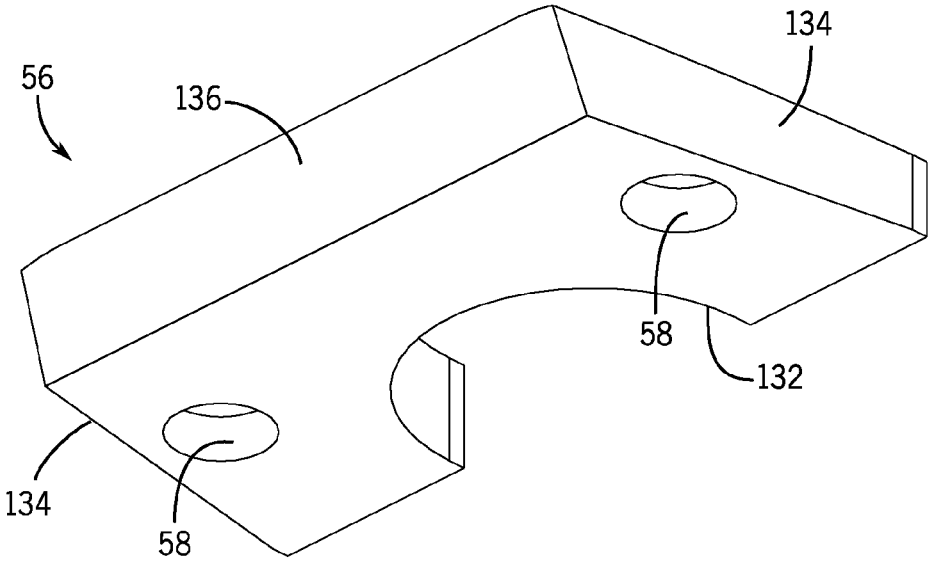
Figure 15:
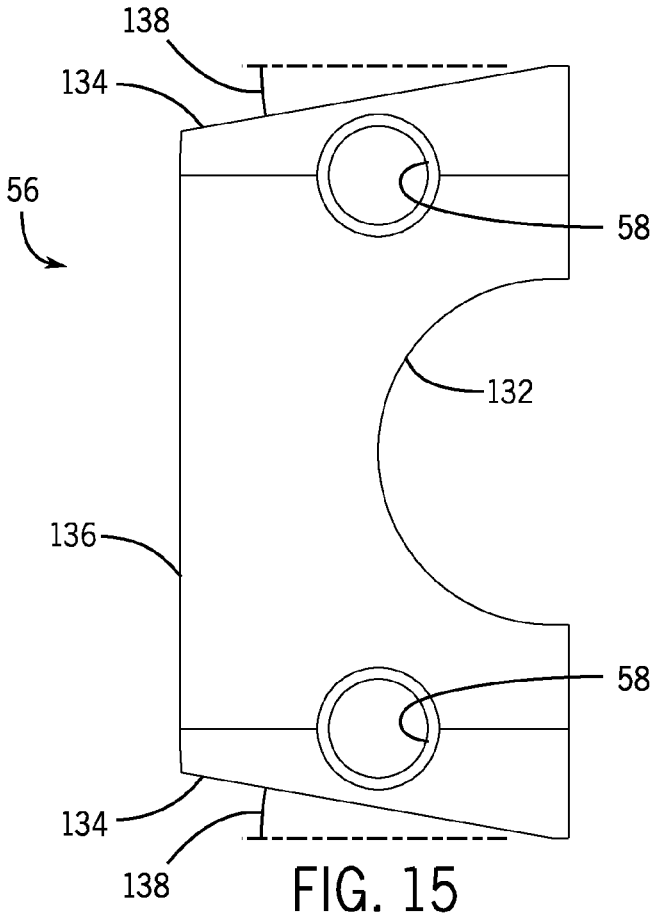

Turning now to FIGS. 13-15, the top plate 56 includes a recess 132 for receiving the rod 38 when the ram assembly 36 is moved into its closed position. The holes 58 allow fasteners 60 to secure the top plate 56 to the rider ram 52, as discussed above. In at least some embodiments, these holes 58 are formed to provide a clearance with respect to installed fasteners 60 to allow the top plate 56 to move relative to the seal 54 and the rider ram 52. In such embodiments, the ram assemblies 36 can be designed such that the top plates 56 of opposing rams contact each other as the ram assemblies 36 close against one another and cause the top plates 56 to compress their respective seals 54. As also noted above, the holes 58 can be counter-bored at the underside of the top plate 56 to receive the spacer rings 64. The counter-bored portions of the holes 58 in one embodiment are designed to minimize material flow and yet allow movement of the spacer rings 64.

Various surfaces of the top plate 56, such as opposing sides 134, can be designed with draft angles to reduce installation misfit with the seal 54 and increase sealing compression when the ram assemblies 36 are closed. For example, in one embodiment opposing sides 134 of the top plate 56 are formed at angles 138 and tapered with draft angles to facilitate engagement with the sides 124 of the recessed portion 120 of the seal 54. Rear face 136 of the top plate 56 can also be tapered with a draft angle to facilitate mating engagement with a similarly tapered front face 128 of the seal 54.

Operation of a pair of opposing ram assemblies 36 in the blowout preventer 22 can be better understood with reference to FIGS. 16-21. Beginning with FIGS. 16 and 17, these figures are top plan views of two ram assemblies 36 within cavities 140 of the body 32 of the blowout preventer 22 and positioned opposite one another about the rod 38. The ram assemblies 36 are depicted in an open position retracted from the rod 38 in FIG. 16. To seal the bore 34, the ram assemblies 36 can be moved, as generally represented by arrows 142, from this open position to a closed position depicted in FIG. 17. As will be appreciated, the ram assemblies 36 can be moved between the open and closed positions with the rods 40.

Figure 16:
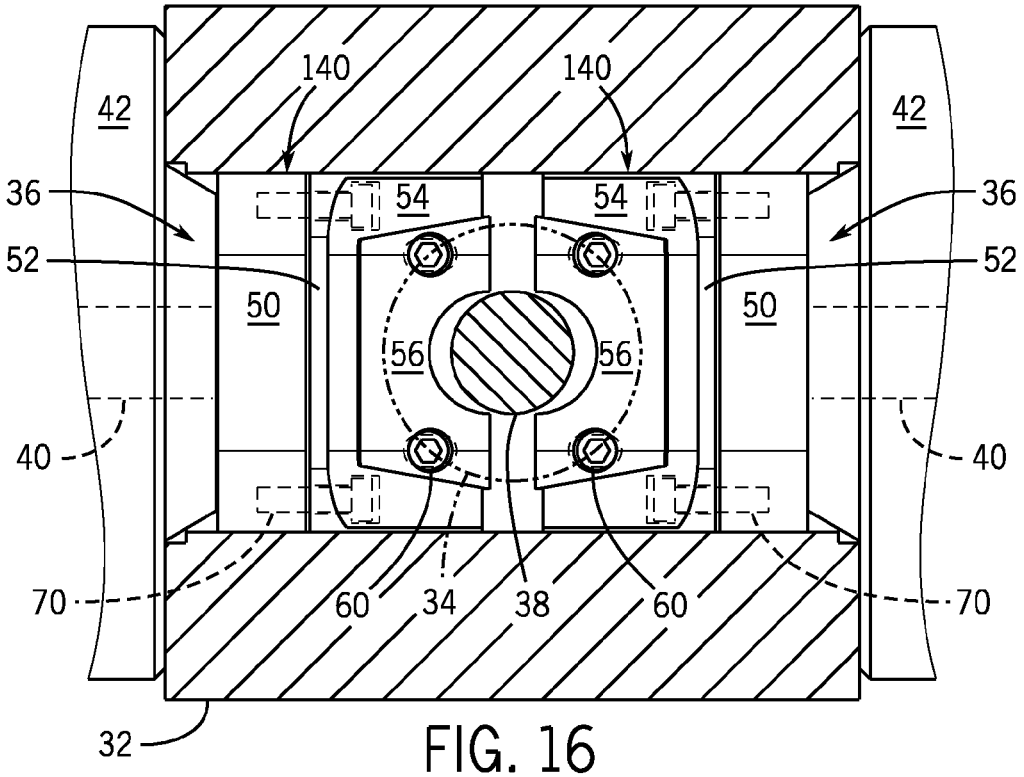
FIG. 16 is a top view of the blowout preventer of FIGS. 2 and 3, with a portion of the body of the blowout preventer removed to show ram assemblies in an open position in which they are retracted from the bore in accordance with one embodiment.
Figure 17:
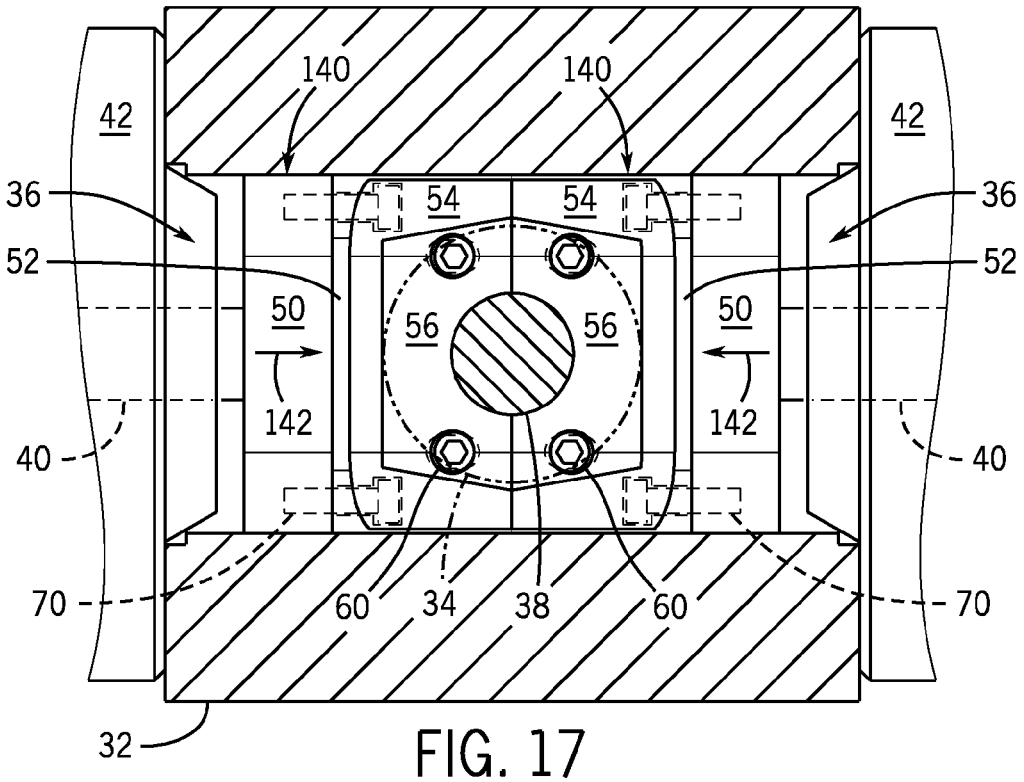
FIG. 17 is also a top view of the blowout preventer as in FIG. 16, but shows the ram assemblies in a closed position to seal the bore of the blowout preventer.
Figure 18:
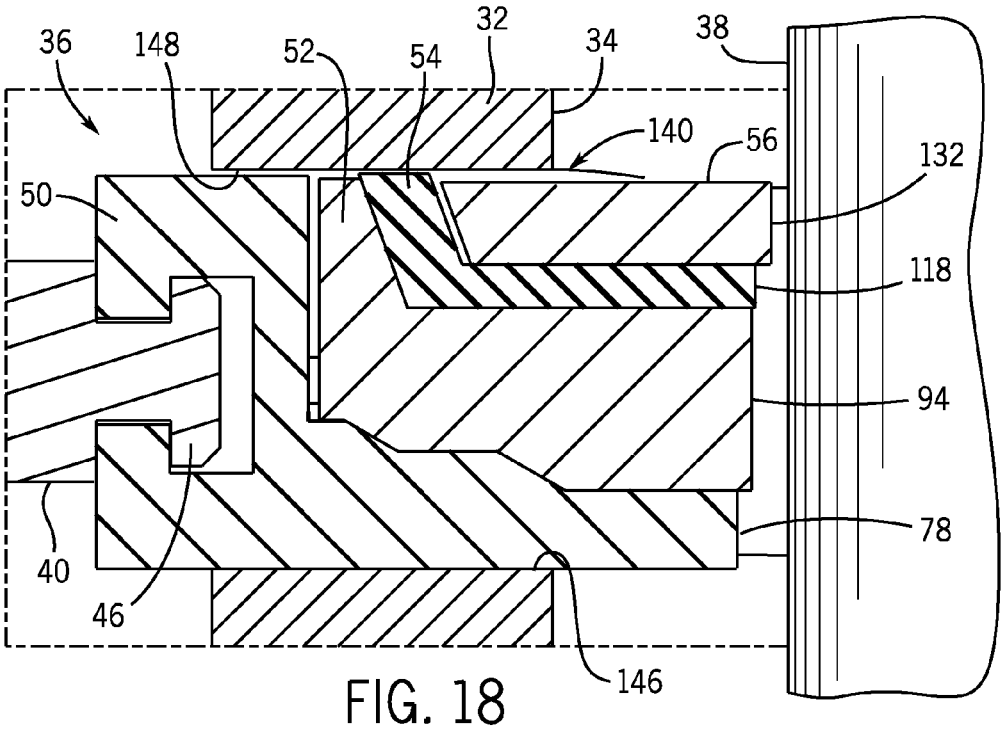
FIGS. 18-21 are detail views generally showing the closing of one of the ram assemblies of FIGS. 16 and 17 and the wedging of a base ram between other components of the ram assembly and the blowout preventer body to cause the seal to be pushed both against a rod within the bore of the blowout preventer and upward against the blowout preventer body in accordance with one embodiment.
Figure 19:
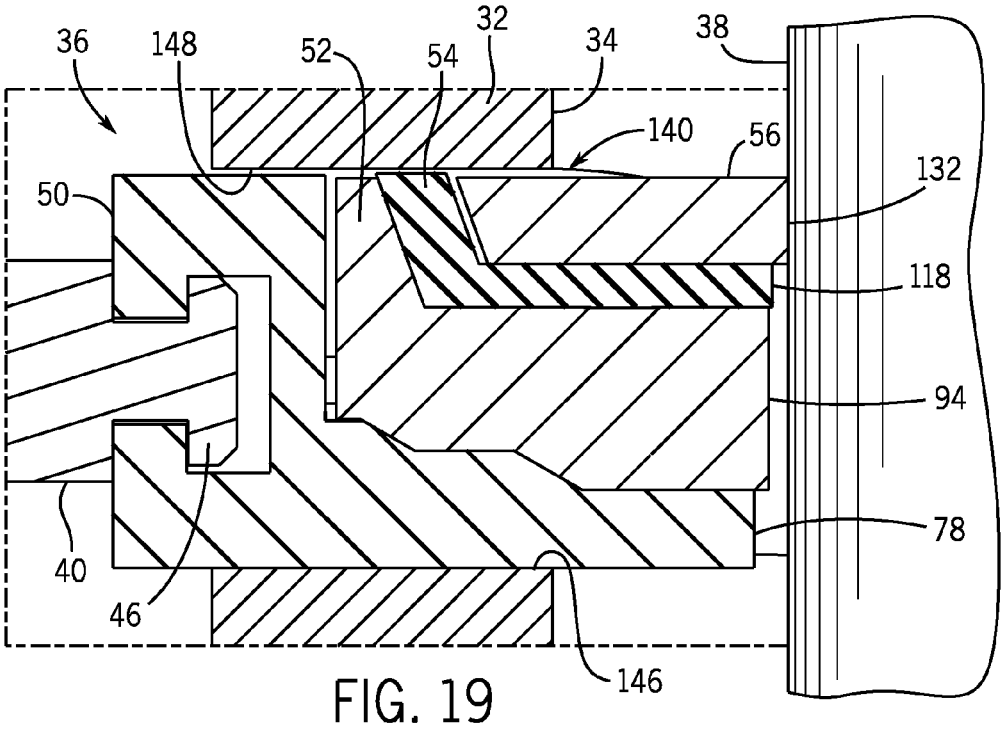
Figure 20:
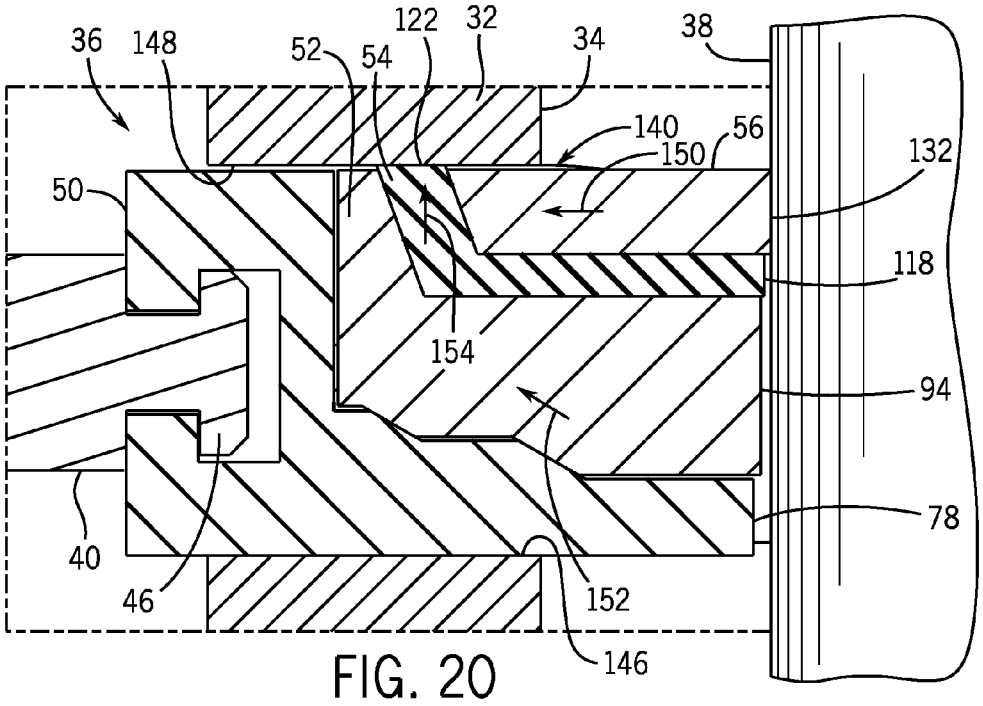

Transverse cross-sections of a ram assembly 36 within the body 32 of the blowout preventer 22 are provided in FIGS. 18-21 and generally depict interaction between the components of the ram assembly 36 as it is moved toward the closed position of FIG. 17 from the open position of FIG. 16. As depicted in FIG. 18, the ram assembly 36 is installed in a cavity 140 of the blowout preventer body 32 between a lower surface 146 and an upper surface 148. The rider ram 52 is shown here as being carried on the tapered surface of the base ram 50. In turn, the seal 54 is carried on the rider ram 52, with the top plate 56 carried on the seal 54.

The base ram 50 can be pushed from the open position to the closed position by the rod 40, which also causes movement of the other components of the ram assembly 36 carried by the base ram 50 (e.g., the rider ram 52, the seal 54, and the top plate 56). In FIG. 18, the ram assembly 36 has not yet closed about the rod 38. But in FIG. 19, the ram assembly 36 has been moved further to the right so that the top plate 56 contacts the rod 38. As the rod 40 continues to push the base ram 50 toward the rod 38, the rod 38 pushes (generally represented by arrow 150 in FIG. 20) the top plate 56 against the front face 128 of the seal 54, which is driven against the front face 114 of the rider ram 52. This, in turn, causes the rider ram 52 to slide up along the tapered portion of the base ram 50, as generally represented by arrow 152, which pushes upper surface 122 of the seal 54 into engagement against the upper surface 148 (arrow 154). As the seal 54 and top plate 56 are carried by the rider ram 52, the seal 54 and the top plate 56 also slide (along with the rider ram 52) relative to the base ram 50.

Figure 21:
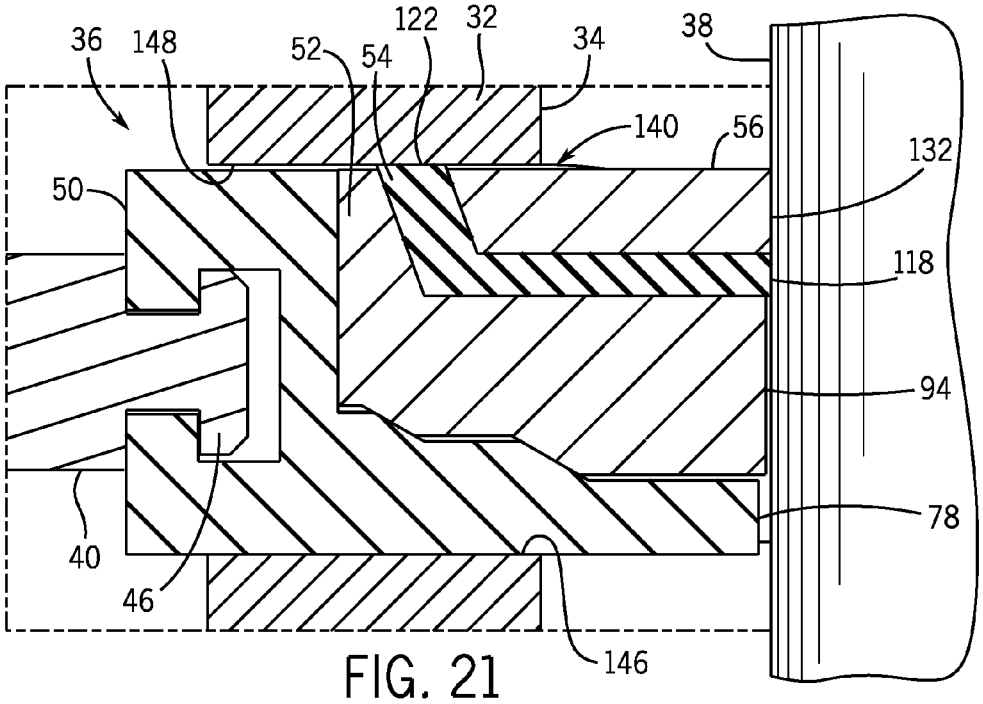

Continued movement of the base ram 50 toward the rod 38 causes the rider ram 52 to slide further up the tapered portion of the base ram 50 (compressing seal 54 further against upper surface 148) and to bottom out against the shoulder 86 of the base ram 50, as generally depicted in FIG. 21. This allows the shoulder 86 to provide additional loading to compress the seal 54 against the rod 38 and against a seal 54 of an opposing ram. In some embodiments, the base rams 50 of opposing ram assemblies 36 are driven toward the rod 38 until the base rams 50 contact one another, which provides a hard stop for the ram assemblies 36 as they are moved into the closed, sealing position.

The base ram 50 and the rider ram 52 can be sized to allow the rider ram 52 to slide along the tapered surface of the base ram 50 and into contact with the upper surface 148 of the body 32. In those instances in which the rider ram 52 contacts the upper surface 148 before the ram assembly 36 is fully closed into its sealing position, the rider ram 52 can be dragged along the upper surface 148 as the base ram 50 is pushed further toward the rod 38 to close the ram assembly 36 into its sealing position.

From the above description, it will be appreciated that a base ram of a ram assembly can be wedged between a seal and a surface of a cavity in a blowout preventer to drive the seal against an opposite surface of the cavity. In some instances, intervening components can be provided between the base ram and the seal, such as the rider ram 52 interposed between the base ram 50 and the seal 54. In such embodiments, wedging the base ram between the seal and a first surface of the blowout preventer body to drive the seal against an opposite, second surface includes wedging the base ram between the rider ram and the first surface to compress the seal against the second surface. But in other embodiments, ram assemblies include base rams having tapered surfaces that directly engage mating surfaces of seals. This allows the seals to slide directly along the tapered surfaces of the base rams as the base rams are wedged between the seals and surfaces of blowout preventer bodies.

Figure 22:
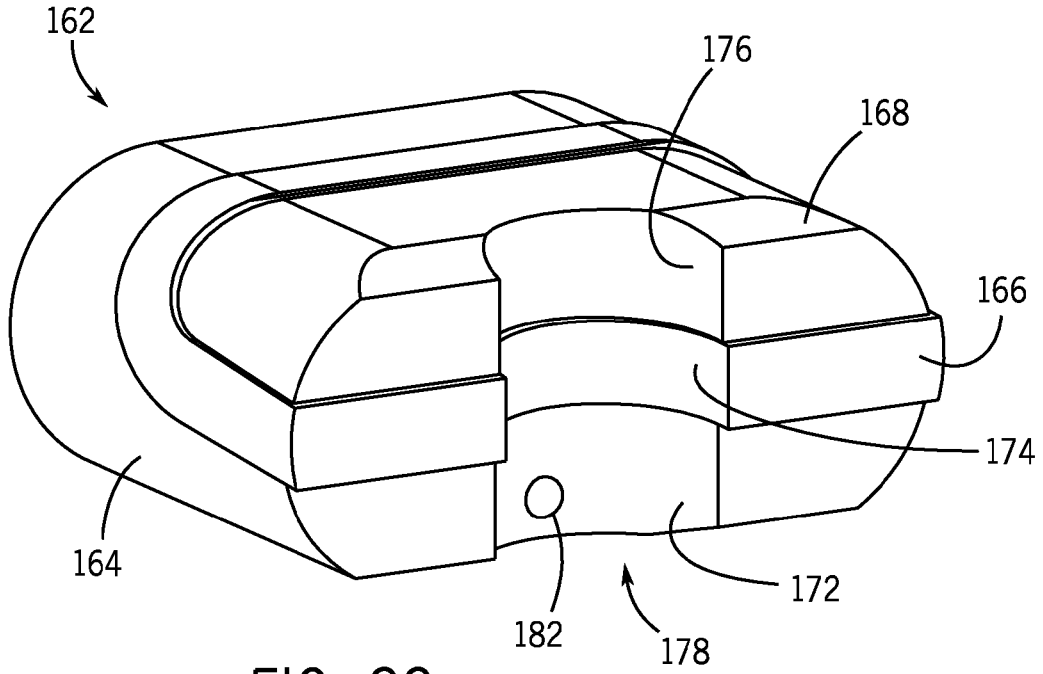
FIGS. 22 and 23 are perspective views of another ram assembly that could be used in the blowout preventer of FIG. 1, this ram assembly having a tapered base ram with a curved surface and a seal positioned directly on the curved surface, in accordance with one embodiment.
Figure 23:
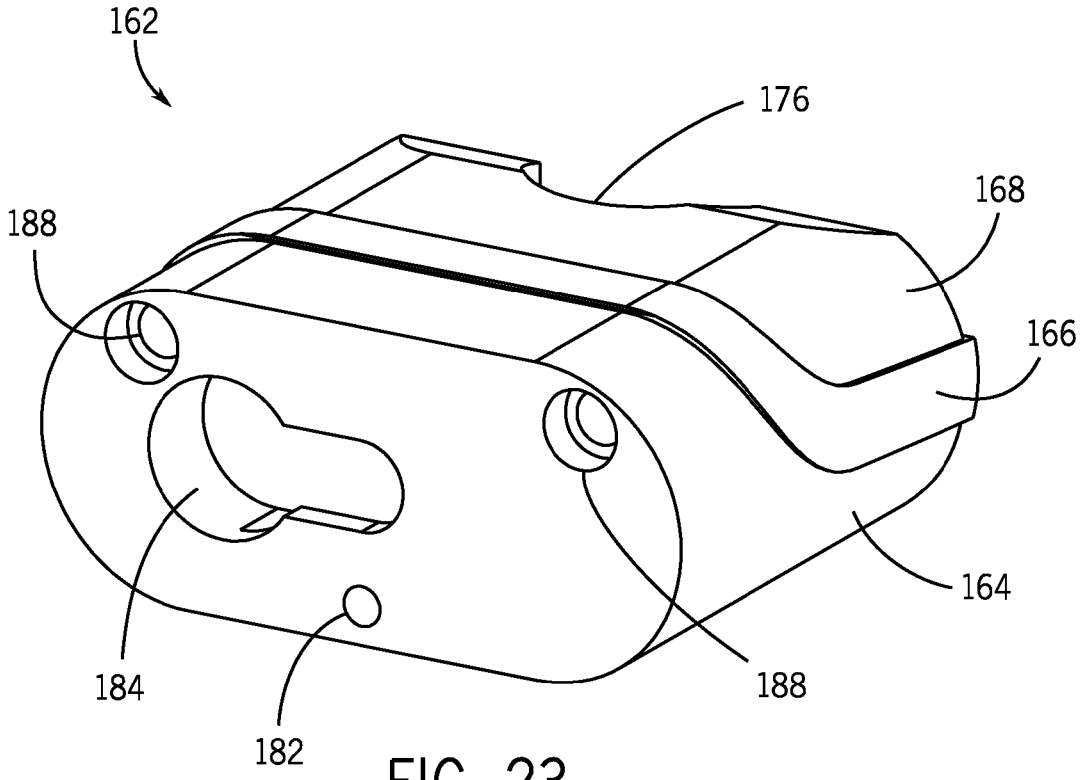
Figure 24:
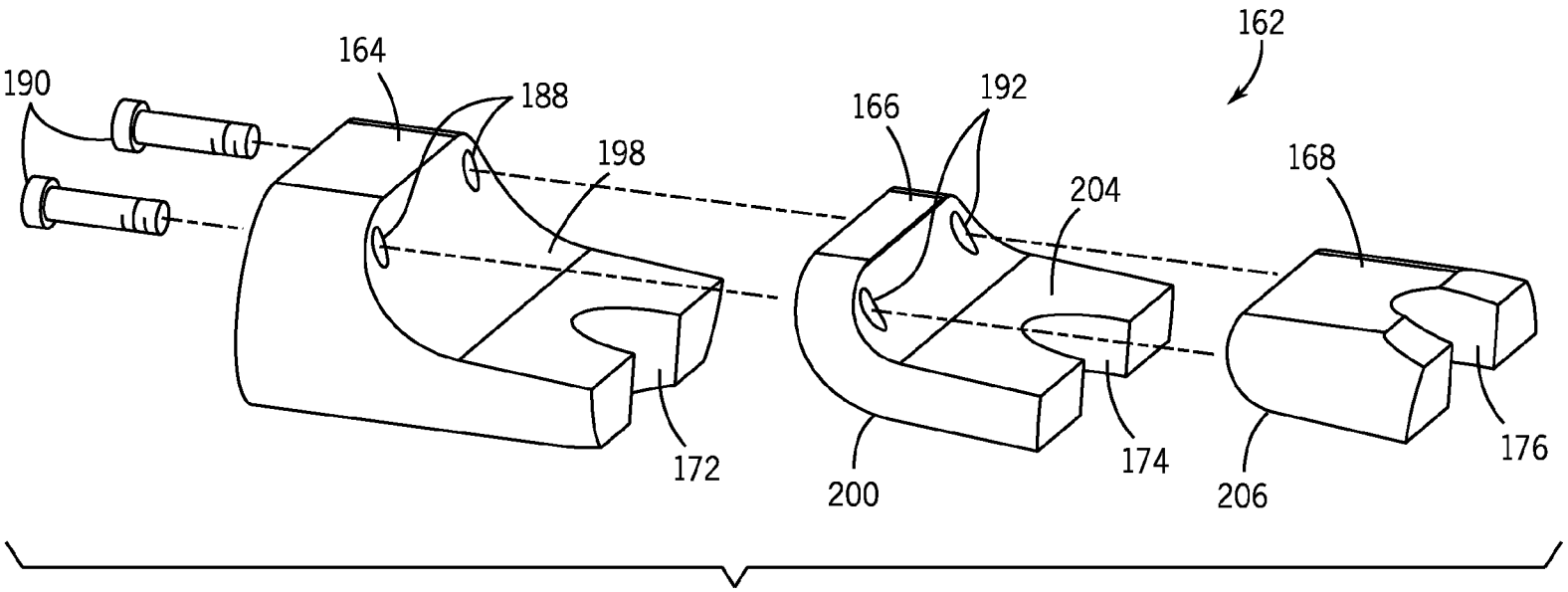
FIG. 24 is an exploded view of the ram assembly of FIGS. 22 and 23.
Figure 25:
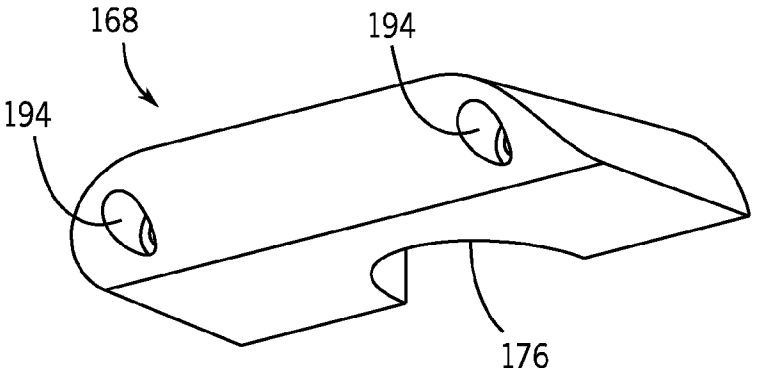
FIG. 25 is a perspective view of a top plate of the ram assembly of FIGS. 22-24.

One example of a ram assembly having a seal positioned in contact with a tapered base ram is generally depicted in FIGS. 22-24. As shown, a ram assembly 162 includes a base ram 164, a seal 166, and a top plate 168. These components include recesses 172, 174, and 176, respectively, which generally define a recess 178 of the ram assembly 162. A hole 182 extends through the base ram 164 and facilitates routing of wellbore pressure from the front of the ram assembly 162 (FIG. 22) to its rear (FIG. 23). The base ram 164 includes a keyhole slot 184 for receiving a button 46 of a rod 40. As shown in FIGS. 24 and 25, the base ram 164 includes holes 188 for receiving fasteners 190 (e.g., cap screws). These fasteners 190 can be inserted through the holes 188, through holes 192 in the seal 166, and then threaded into holes 194 (FIG. 25) of the top plate 168 to retain these components to one another.

The base ram 164 includes a tapered surface 198 that cooperates with a mating surface 200 of the seal 166 to enable the base ram 164 to compress the seal 166 in orthogonal directions as the ram assembly 162 is moved into a closed position (e.g., a first direction parallel to the direction of movement of the ram assembly 162 as it is closed and a second direction perpendicular to the first). As depicted, the tapered surface 198 and the mating surface 200 are curved surfaces. But these surfaces could be provided in any other desired forms (e.g., the tapered surface 198 could have a flat, planar taper). The seal 166 also includes a surface 204 for engaging a surface 206 of the top plate 168. Though presently shown as curved, the surfaces 204 and 206 (like the surfaces 198 and 200) can also be provided in any desired form.

Figure 26:
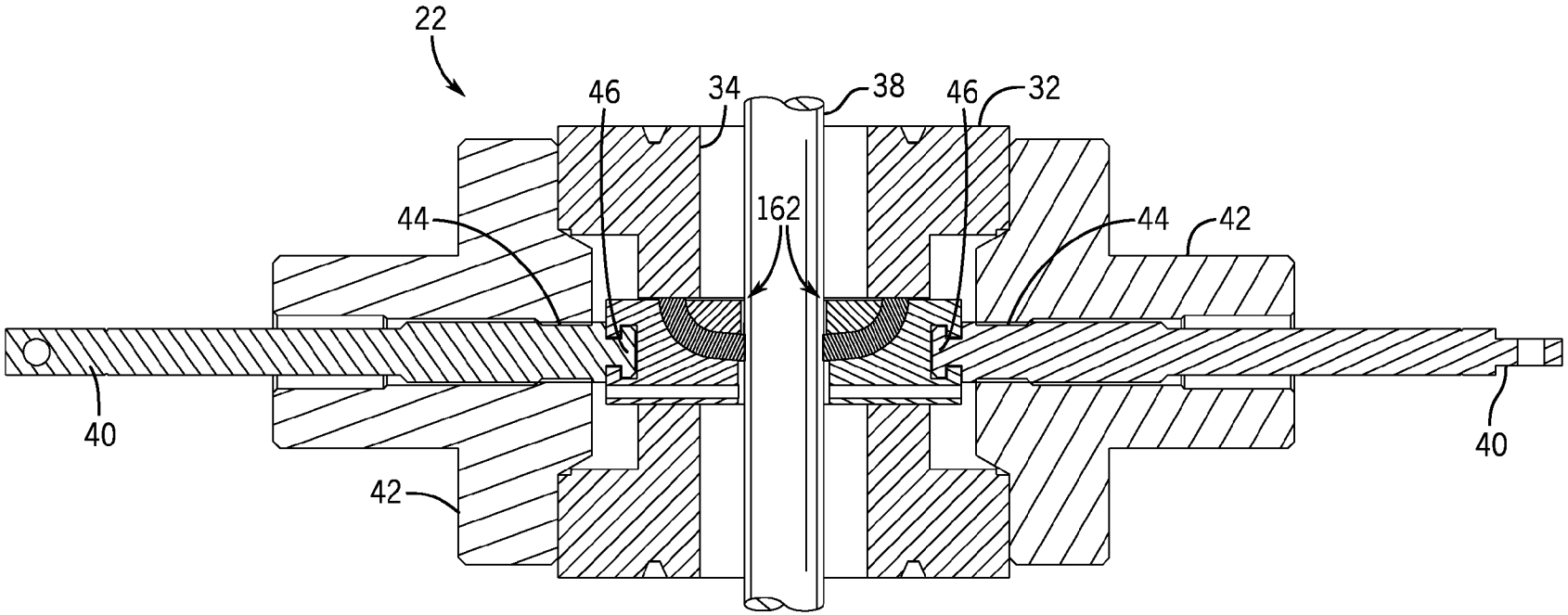
FIG. 26 is a cross-section that depicts a blowout preventer having a pair of ram assemblies identical to that shown in FIGS. 22-24 in accordance with one embodiment.
Figure 27:
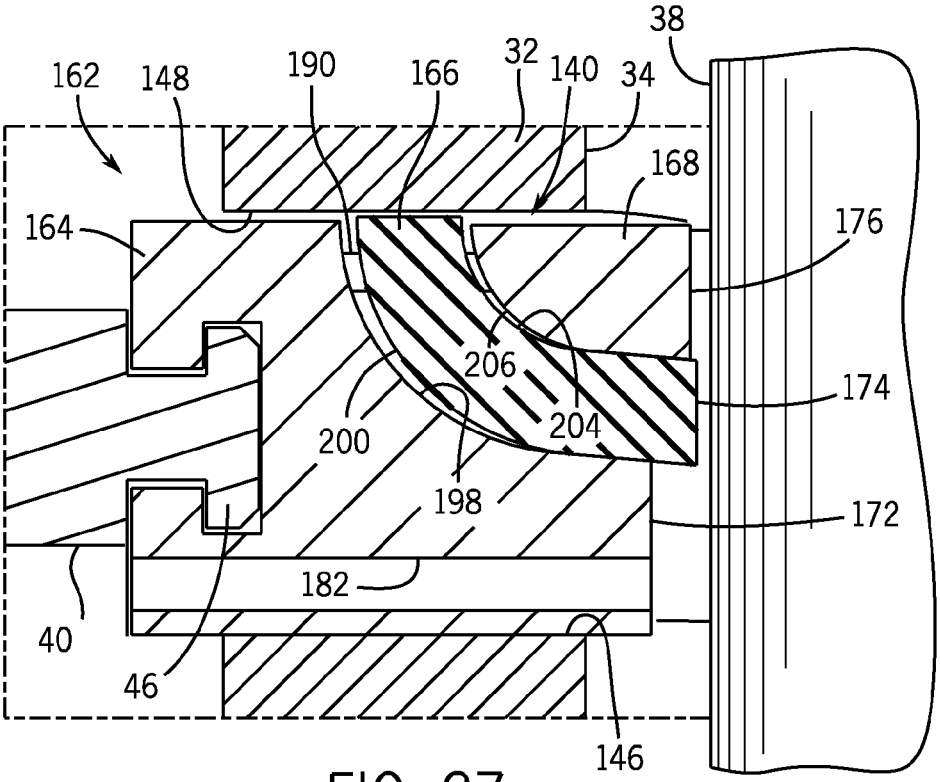
FIGS. 27-29 are detail views generally showing the closing of one of the ram assemblies within the blowout preventer of FIG. 26 and the wedging of its base ram between other components of the ram assembly and the blowout preventer body to cause the seal to be pushed both against a rod within the bore of the blowout preventer and upward against the blowout preventer body in accordance with one embodiment.
Figure 28:
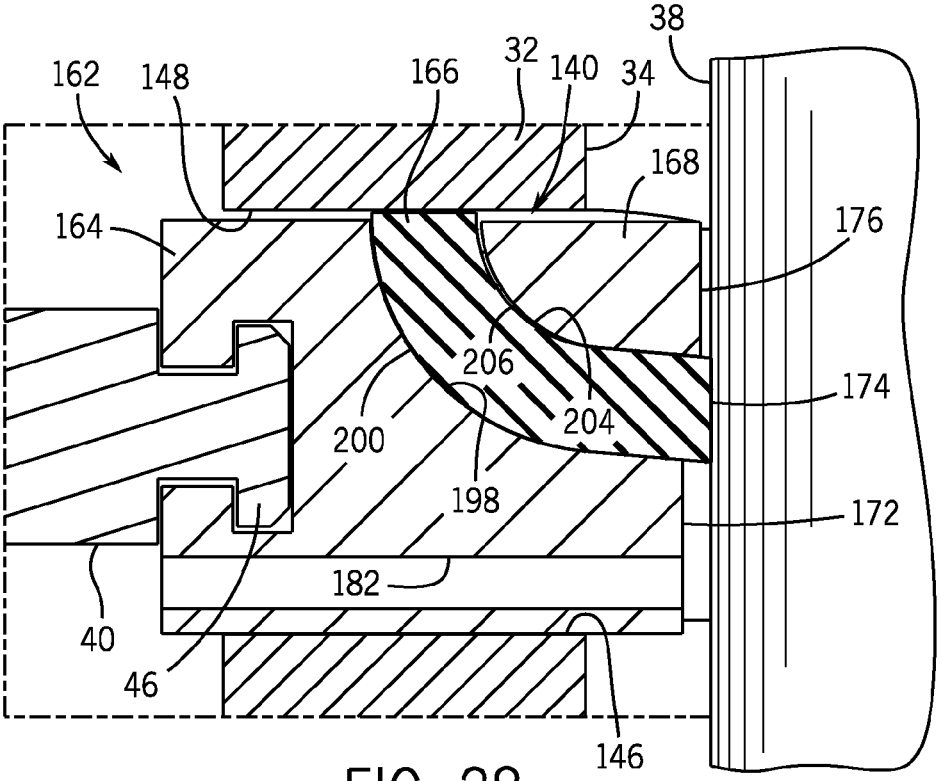
Figure 29:
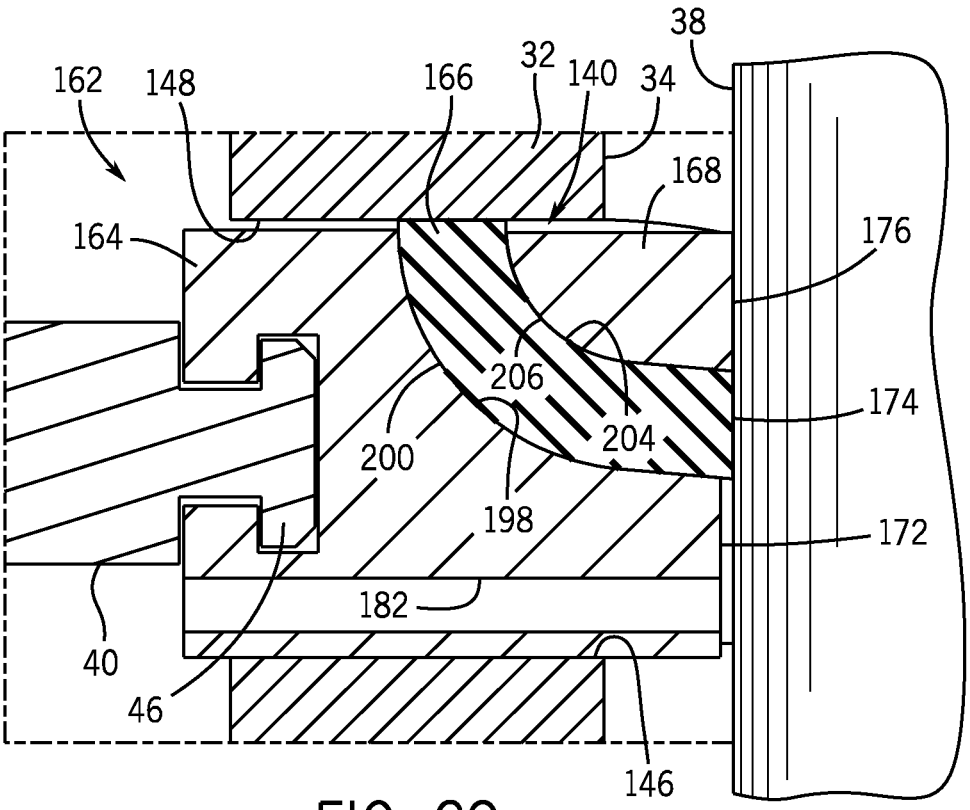

The ram assemblies 162 can be installed in the blowout preventer 22, as generally depicted in FIG. 26, and used to seal the bore 34 in a manner similar to that of the ram assemblies 36. The rods 40 can be operated to move the ram assemblies 162 between their open and closed positions. By way of example, a closing sequence for a ram assembly 162 is generally depicted in FIGS. 27-29. In FIG. 27, the ram assembly 162 has been pushed (from left to right in this view) into a position near the rod 38. Further movement of the ram assembly 162 to the right causes the seal 166 to contact the rod 38, as generally shown in FIG. 28, as well as a seal 166 of an opposing ram assembly 162. This pushes the depicted seal 166 back against the base ram 164 and causes the surface 200 to slide up along the tapered surface 198 of the base ram 164. As the base ram 164 is wedged between the seal 166 and the lower surface 146, the mating engagement of the tapered surface 198 with the surface 200 causes the base ram 164 to compress the seal 166 both horizontally against the rod 38 (and an opposing seal 166) and vertically against the upper surface 148. Additional closing movement of the base ram 164 brings the top plate 168 into contact with the rod 38, as depicted in FIG. 29. This pushes the top plate 168 against the seal 166. Further, contact between the top plate 168 and the rod 38 inhibits extrusion of the seal 166 between those two components.

Figure 30:
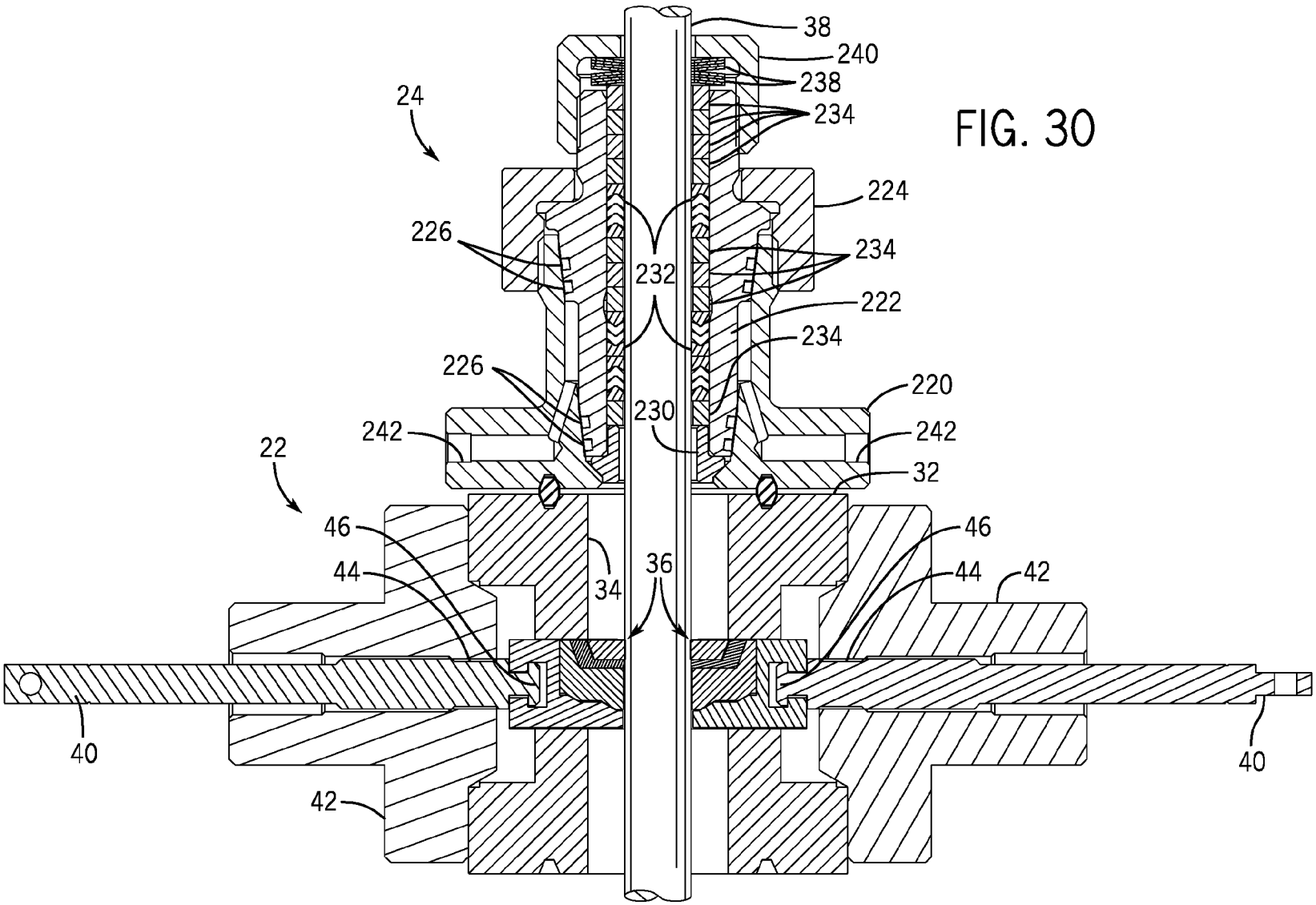
FIG. 30 depicts an example of the stuffing box of FIG. 1 coupled to a blowout preventer in accordance with one embodiment.

As generally described above with respect to FIG. 1, a stuffing box 24 can be coupled to the blowout preventer 22. One example of such a stuffing box 24 is generally depicted in FIG. 30. In this embodiment, the stuffing box 24 includes a flanged connector 220 that can be coupled to the top of the blowout preventer 22 in any suitable manner, such as with studs and bolts (not shown). Although the blowout preventer 22 is shown here as including ram assemblies 36, it will be understood that the blowout preventer 22 could instead include other ram assemblies. The stuffing box 24 generally provides dynamic sealing to inhibit leakage of fluid along a rod 38 (e.g., a polished rod) extending through the stuffing box 24 and the blowout preventer 22. An inner body 222 of the stuffing box 24 is positioned within the connector 220 and retained by a collar 224 on the connector 220. Seals 226 are provided between the inner body 222 and the connector 220. In one embodiment, these seals 226 are static seals constructed for use at 650° F. or other high temperatures (such as those that can be encountered in SAGD operations).

A seal assembly having one or more seals 232 is also provided within the inner body 222 on a support ring 230 to seal against the rod 38. The seals 232 can be provided as high-temperature dynamic seal packs that maintain sealing against the rod 38 even as it moves with respect to the seals 232. In some embodiments, the seals 232 are formed with a flexible graphite packing material. Spacers 234 are provided with the seals 232 inside the annulus between the inner body 222 and the rod 38. Further, disc springs 238 are installed above this annulus and loaded by end cap 240 to apply a desired preload on the seals 232 of the seal assembly. For example, the end cap 240 can be threaded onto the inner body 222 and the amount of preload applied by the disc springs 238 can be controlled through rotation of the end cap 240. Ports 242 allow grease or packing intervention, as well as testing of seal performance within the stuffing box 24 without closing the ram assemblies of the blowout preventer 22.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a ram assembly including:

a base ram having a tapered profile; and a seal coupled to the base ram in a manner that allows the seal to slide relative to the base ram during operation of the ram assembly;

wherein the ram assembly includes a rider ram positioned between the base ram and the seal and coupled to the base ram in a manner that permits sliding of the rider ram with respect to the base ram during operation of the ram assembly, and wherein the seal and the rider ram are coupled in a manner that enables the seal to slide relative to the rider ram during operation of the ram assembly.

2. The system of claim 1, wherein the rider ram and the base ram having mating tapered profiles.

3. The system of claim 1, comprising a plate positioned within a recess of the seal and coupled to the rider ram with the seal disposed between the plate and the rider ram.

4. The system of claim 1, wherein the seal has an upper surface shaped to seal against a cavity of a blowout preventer and a distal surface shaped to seal about a cylindrical member.

5. The system of claim 1, wherein the tapered profile of the base ram enables movement of the base ram in a first direction to cause compression of the seal in both the first direction and a different second direction.

6. The system of claim 1, comprising a blowout preventer having a pair of the ram assemblies.

7. The system of claim 1, wherein the tapered profile of the base ram includes an inclined surface and the rider ram is positioned on the inclined surface so as to allow the rider ram to slide up the inclined surface of the base ram during closing of the ram assembly.

8. A system comprising:

a blowout preventer having a hollow body and two ram assemblies positioned in the hollow body opposite one another to allow the two ram assemblies to close against one another, each of the two ram assemblies including a base ram that has a tapered profile and a seal such that, during operation of the blowout preventer, movement of the two ram assemblies to a closed position within the blowout preventer causes the base rams to compress the seals against one another and also against the hollow body of the blowout preventer, wherein the seal and the base ram of each ram assembly have mating curvatures that contact one another to allow the seal and the base ram to move relative to one another by sliding along the mating curvatures.

9. The system of claim 8, comprising a wellhead on which the blowout preventer is installed.

10. The system of claim 8, comprising a stuffing box coupled to the blowout preventer and a polished rod extending through the stuffing box and the blowout preventer, wherein the stuffing box includes a seal assembly in contact with the polished rod and includes one or more disc springs that apply a preload to the seal assembly.

11. A system comprising:

a blowout preventer having a hollow body and two ram assemblies positioned in the hollow body opposite one another to allow the two ram assemblies to close against one another, each of the two ram assemblies including a base ram that has a tapered profile and a seal such that, during operation of the blowout preventer, movement of the two ram assemblies to a closed position within the blowout preventer causes the base rams to compress the seals against one another and also against the hollow body of the blowout preventer;

wherein each of the two ram assemblies also includes a rider ram positioned between the base ram and the seal, the seal is coupled to the base ram in a manner that allows the seal to slide relative to the base ram during operation of the ram assembly, the rider ram is coupled to the base ram in a manner that permits sliding of the rider ram with respect to the base ram during operation of the ram assembly, and the seal and the rider ram are coupled in a manner that enables the seal to slide relative to the rider ram during operation of the ram assembly.

12. The system of claim 11, comprising a stuffing box coupled to the blowout preventer and a polished rod extending through the stuffing box and the blowout preventer, wherein the stuffing box includes a seal assembly in contact with the polished rod and includes one or more disc springs that apply a preload to the seal assembly.

13. The system of claim 11, wherein the rider rams of the two ram assemblies have tapered profiles complementary to the tapered profiles of the base rams such that, during operation of the blowout preventer, movement of the two ram assemblies to the closed position within the blowout preventer causes the base rams to compress the seals against the hollow body of the blowout preventer via the rider rams.

14. The system of claim 13, wherein the complementary tapered profiles of the rider rams and the base rams include mating inclined surfaces that cause the rider rams to lift off of other surfaces of the base rams to compress the seals against the hollow body of the blowout preventer during movement of the two ram assemblies to the closed position.

* * * * *